US010316536B2

(12) United States Patent
Stauffer

(10) Patent No.: US 10,316,536 B2
(45) Date of Patent: Jun. 11, 2019

(54) MASS TRANSIT RUSH HOUR TRAFFIC BOTTLENECK UNCORKER WATER SLIDE

(71) Applicant: David William Stauffer, Portland, OR (US)

(72) Inventor: David William Stauffer, Portland, OR (US)

( * ) Notice: Subject to any disclaimer, the term of this patent is extended or adjusted under 35 U.S.C. 154(b) by 150 days.

(21) Appl. No.: 14/718,022

(22) Filed: May 20, 2015

(65) Prior Publication Data

US 2016/0340923 A1 Nov. 24, 2016

(51) Int. Cl.

| | |
|---|---|
| ***E04H 6/42*** | (2006.01) |
| ***E04H 6/10*** | (2006.01) |
| *B63B 35/00* | (2006.01) |

(52) U.S. Cl.

CPC ..... *E04H 6/42* (2013.01); *E04H 6/10* (2013.01); *B63B 2035/004* (2013.01)

(58) Field of Classification Search

CPC .. A63G 21/18; E04H 6/42; E04H 6/10; B65G 51/01; B63B 35/00; B63B 2035/004

See application file for complete search history.

(56) References Cited

U.S. PATENT DOCUMENTS

| | | | | | |
|---|---|---|---|---|---|
| 419,860 | A * | 1/1890 | Libbey | A63G 3/00 | 104/129 |
| 689,114 | A * | 12/1901 | Pape | A63G 3/00 | 104/73 |
| 873,570 | A * | 12/1907 | Mangels | A63G 3/00 | 104/59 |
| 891,388 | A * | 6/1908 | Grote | A63G 3/00 | 104/172.5 |
| 3,404,635 | A * | 10/1968 | Bacon | A63G 3/00 | 104/70 |
| 3,930,450 | A * | 1/1976 | Symons | A63G 3/00 | 104/139 |
| 2009/0142146 | A1* | 6/2009 | Opatril | B65G 51/01 | 406/10 |

* cited by examiner

*Primary Examiner* — Patrick J Maestri

(57) ABSTRACT

Fabrication of about a thirty-story parking structure where commuters will park and then take elevators to the to of the structure where they will embark on a skiff or small boat and travel down a water trough that goes over the tops of roads, freeways and bridges to the other side of normal traffic bottlenecks, to docking spaces about the third floor of downtown buildings where they will dock their skiffs or boats and disembark on the dock, and their vacated skiffs will go onto a conveyor belt that will take the vacated skiffs to the top of another thirty-story building in the downtown area where commuters wanting to return to the original parking structure will embark on the skiffs going down a similar water slide back to the original parking structure from which they had departed earlier, to get their cars and trucks and drive back to their homes.

4 Claims, 13 Drawing Sheets

AA
Z
Q
A2
DD
T
M
N
CC
X
O
B
U
C
D
V
P
E
R
BB
K
W
DD
H
S
F
G

MASS TRANSIT RUSH HOUR TRAFFIC BOTTLENECK UNCORKER WATER SLIDE

CROSS-REFERENCE TO RELATED APPLICATIONS

In this application, Inventor Stauffer has incorporated his application for a patent on a RIVER BOTTOM SIPHON FOR HYDRO-ELECTRIC GENERATION AND IRRIGATION, patent application Ser. No. 13/734,978.

STATEMENT REGARDING FEDERALLY-SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Fields of the Invention

Siphons, pipelines, river flows, eddies, gravity, parking structures, water slides, water troughs, skiffs, boats, and docks.

2. Description of Related Art including information disclosed under 37 CFR 1.97 and 1.98

There is no related prior art that includes all the limitations of the claimed invention.

BRIEF SUMMARY OF THE INVENTION

A thirty-story parking structure (see T in FIGS. 1 and 2) north of (in the preferred embodiment) Vancouver Wash. (Q in FIGS. 1 and 2), will have parking spaces for many cars and trucks of commuters that will otherwise be driving, and jamming freeways and bridges during rush hours. Commuters will park in the thirty-story parking structure (T in FIGS. 1 and 2) and then take elevators to the top of the structure where they will embark on a skiff or small boat (See FIGS. 3, 4 and 9) to travel down a water slide that goes over the tops of roads, freeways and bridges (see FIGS. 5 and 6) to the other side of normal traffic bottlenecks, to do king spaces on about the third floor of downtown buildings (see FIG. 2) where they will dock their skiffs or boats (see FIGS. 4 and 9) and disembark on the dock—or continue past a particular building to dock at other buildings (see buildings EE and FF in FIG. 2)—or to another thirty-story parking structure (see S in FIG. 1) where they will disembark from their skiff and take an elevator to the top of that parking structure and board another skiff to travel down a water trough back to their original embarking point (see FIG. 1). Their vacated skiffs will go onto a conveyor belt that will take the vacated skiffs to the top of another thirty-story parking structure in the downtown area where commuters wanting to return to Vancouver will embark on the skiffs going down a similar water slide back to the Vancouver parking structure from which they had departed earlier (see FIG. 1), to get in their cars and trucks and drive hack to their homes.

Such a mass transit system will be almost pollution-free, use gravity as its main moving force, and will be much faster—and less tense—than present commuting through bottleneck traffic. The environmental air quality will be greatly improved in all cities or towns that implement this apparatus. Commuters will cut their commuting times in half while their use of fossil fuels—such as gas and fuel oil—will be greatly decreased. The water slides will cause less noise than the cars and trucks on freeways. There will be fewer car and truck engines to make noise, too. Eventually, fewer freeways and roads will be needed—or, at least, the existing freeways and roads will be more efficient because there will be fewer vehicles using them.

BRIEF DESCRIPTION OF THE SEVERAL VIEWS OF THE DRAWINGS

FIG. 1 has no text; so Inventor Stauffer provides the following key to the labels;

Figure 1:
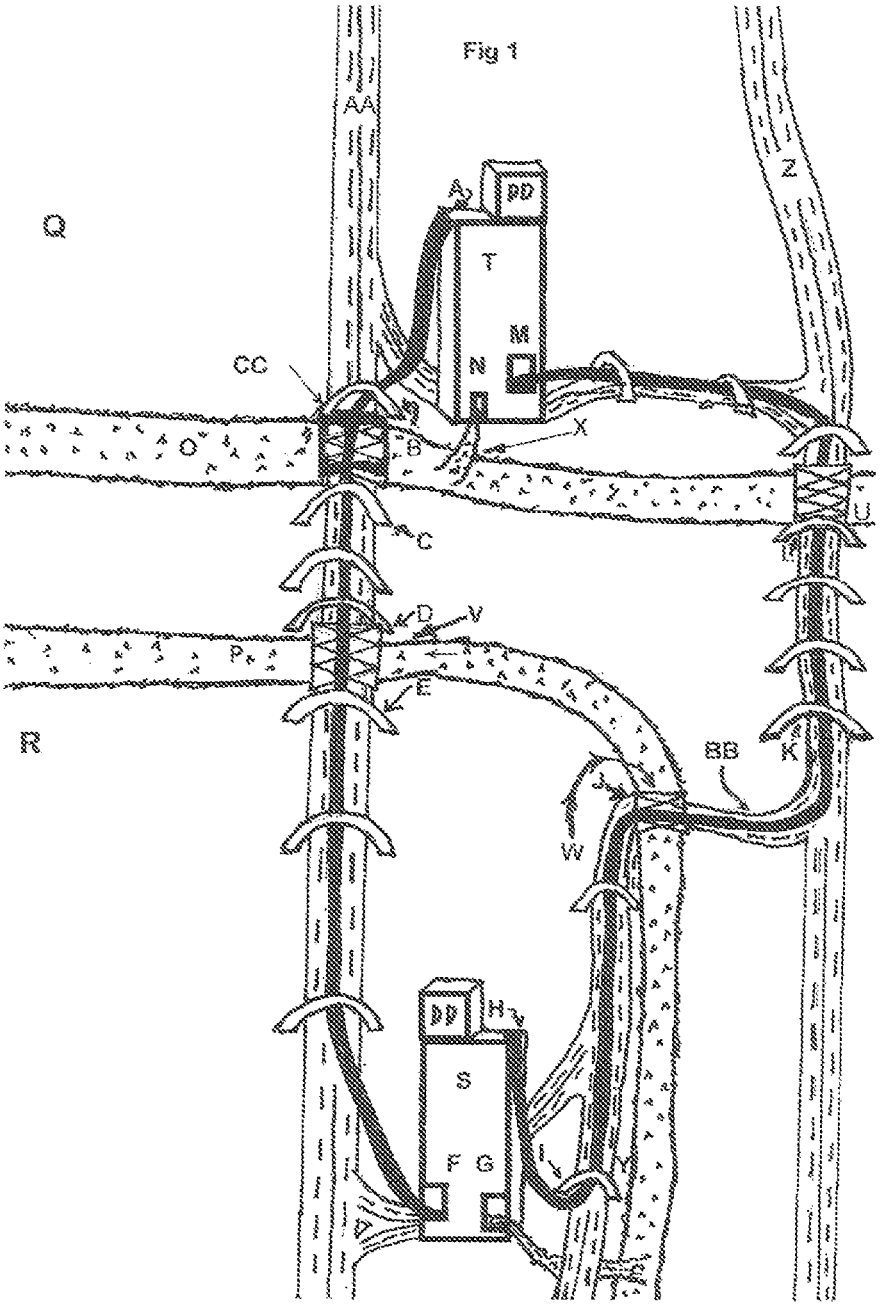
FIG. 1 is one embodiment of the Water Trough Transportation Overview for the bottleneck between Portland, Oreg., and Vancouver, Wash.

- A Start of water trough on $30^{th}$ floor of the Vancouver parking T
- B and C Arches above the bridge on each side of the Columbia River O
- D and E Arches above the bridge on each side of the Willamette River P
- F Dock of water trough on 3rd floor of the Portland parking S
- G Exit for trough water to flow to Willamette River P
- H Start of water trough on $30^{th}$ floor of the Portland parking S
- I, J, K Arches above the freeways and bridges
- L Jackson Bridge over Columbia River O
- M Dock of trough on 3rd floor of the Vancouver parking T
- N Exit for trough water to flow to Columbia River O
- O Columbia River
- P Willamette River
- Q Vancouver, Wash., suburb of Portland, Oreg.
- R Portland, Oreg., city by suburb of Vancouver, Wash.
- S Thirty story parking structure in Portland, Oreg.
- T Thirty story parking structure in Vancouver Wash.
- U Water trough arch over Bridge L over Columbia River O
- V Water trough arch over Fremont Bridge L over'Willamette P
- W Morrison Bridge over Willamette River P
- X Water trough from Vancouver parking T to Columbia O
- Y Water trough arch over freeway.
- Z I-205 freeway.
- AA Interstate 5 freeway.
- BB Interstate 84 freeway.
- CC Interstate Bridge carrying I-5 freeway AA over Columbia O
- DD Top of conveyor that brings skiffs to top of parking structures.

These same principles and concepts can be adapted to many other city town traffic bottlenecks throughout the United States and the world. On the Vancouver side of the Columbia River—maybe slightly north of the Vancouver downtown area—a thirty-story parking garage (T in FIGS. 1 and 2) will be built with ten elevators going from each floor to the top of the building. Cars and trucks will come from the I-5 freeway (AA), the I-205 freeway (Z) and the smaller state highways to this parking garage and park on one of the lower 29 stories. After parking the individuals will take the elevators or stairs to the top of the 30-story building and get into on of the supplied skiffs, or small boats. For the preferred embodiment of the skiffs, see FIGS. 3, 4 and 9. The skiff shall be designed so that commuters will always be able to get out of the skiff even if it turns partially upside down. Steering will be done manually or by means of a Geopolitical Postioning System (GPS—see B in FIG. 3) and computer on each skiff to direct the skiff to a commuter-selected destination so that the commuters on board can talk on their cell phones rather than driving. Both the front and rear of the skiff will be cone shaped (see FIG. 3) so that, if a first skiff (#1) is ever stopped and a second skiff (#2) runs into skiff #1, the #2 skiff will simply glance off the rear cone of skiff #1 and go to a different lane of traffic—there will not be a dangerous crash and abrupt stop. Each skiff will also have air bags and seat belts for any unexpected crashes. The front cone will be filled with air (see A in FIG. 3), so that, if the skiff ever falls from the trough into water, the front of the skiff will go into the water like a bullet or a high-diving-board diver, and then the air pocket will bring the skiff to the top of the river so that the commuters can be rescued. Skiffs will have a of seats: one seat for single passengers and up to three extra seats for parties of four or more (see FIG. 3). There will also be safety nets below the water troughs to catch any person or skiff that falls from the water trough.

Figure 4:
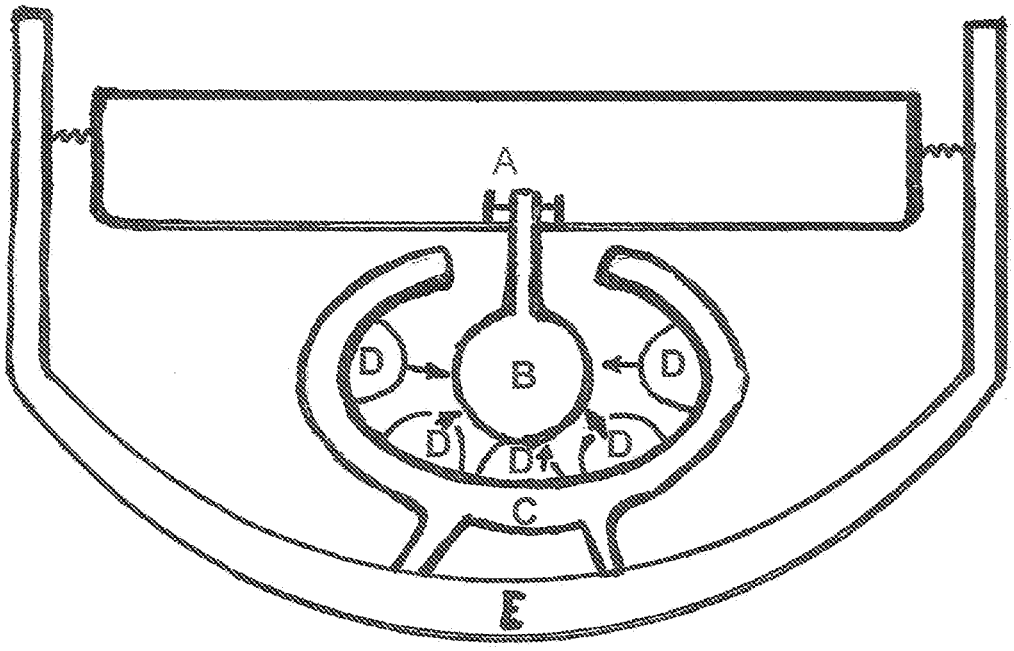
Figure 10:
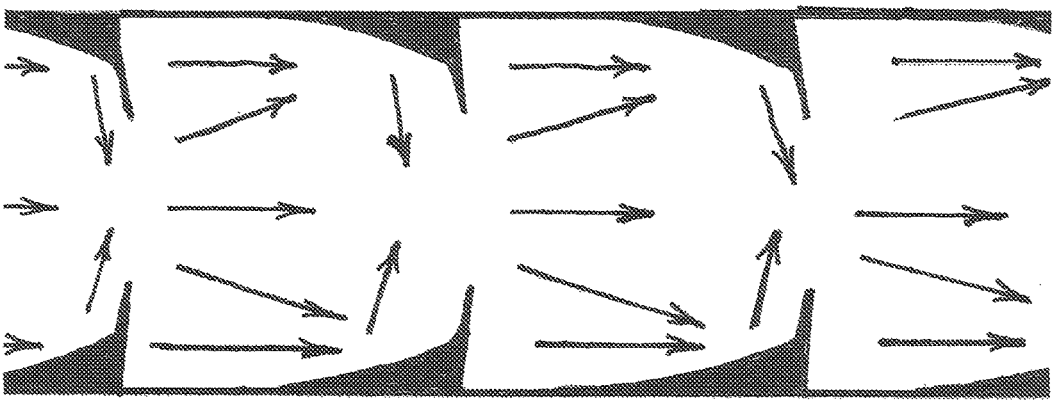
Figure 11:
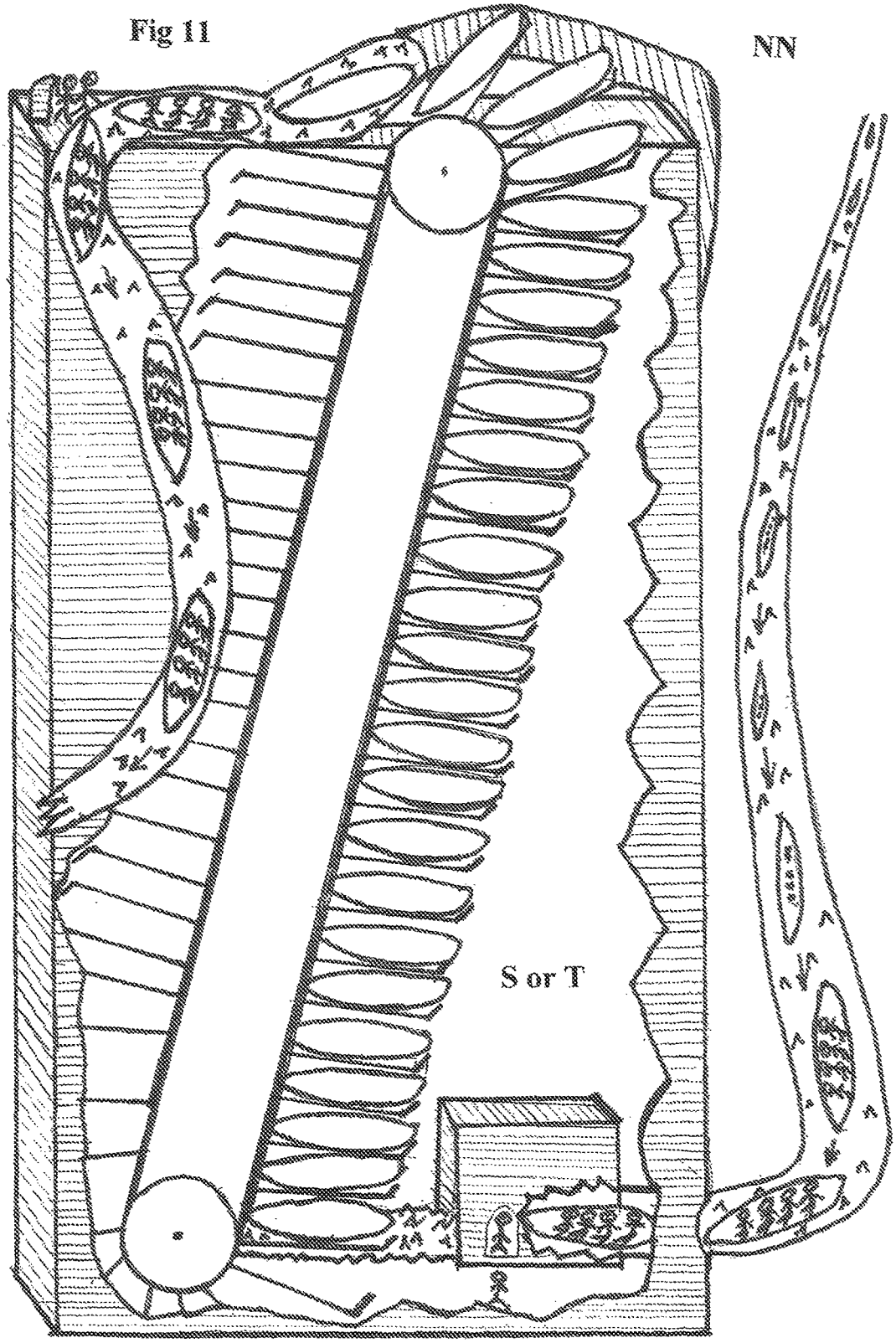
Figure 12:
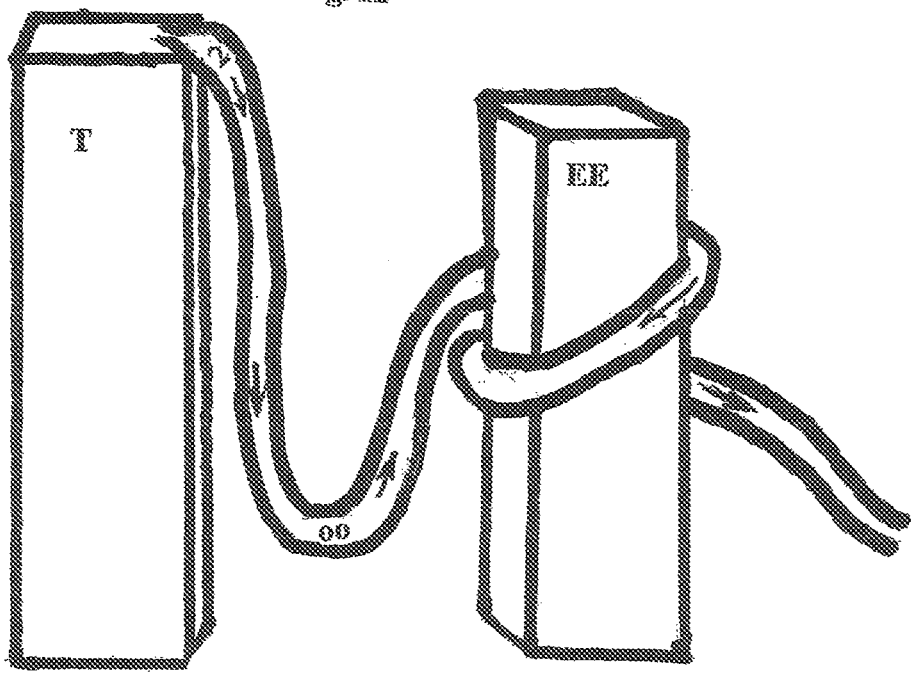
Figure 13:
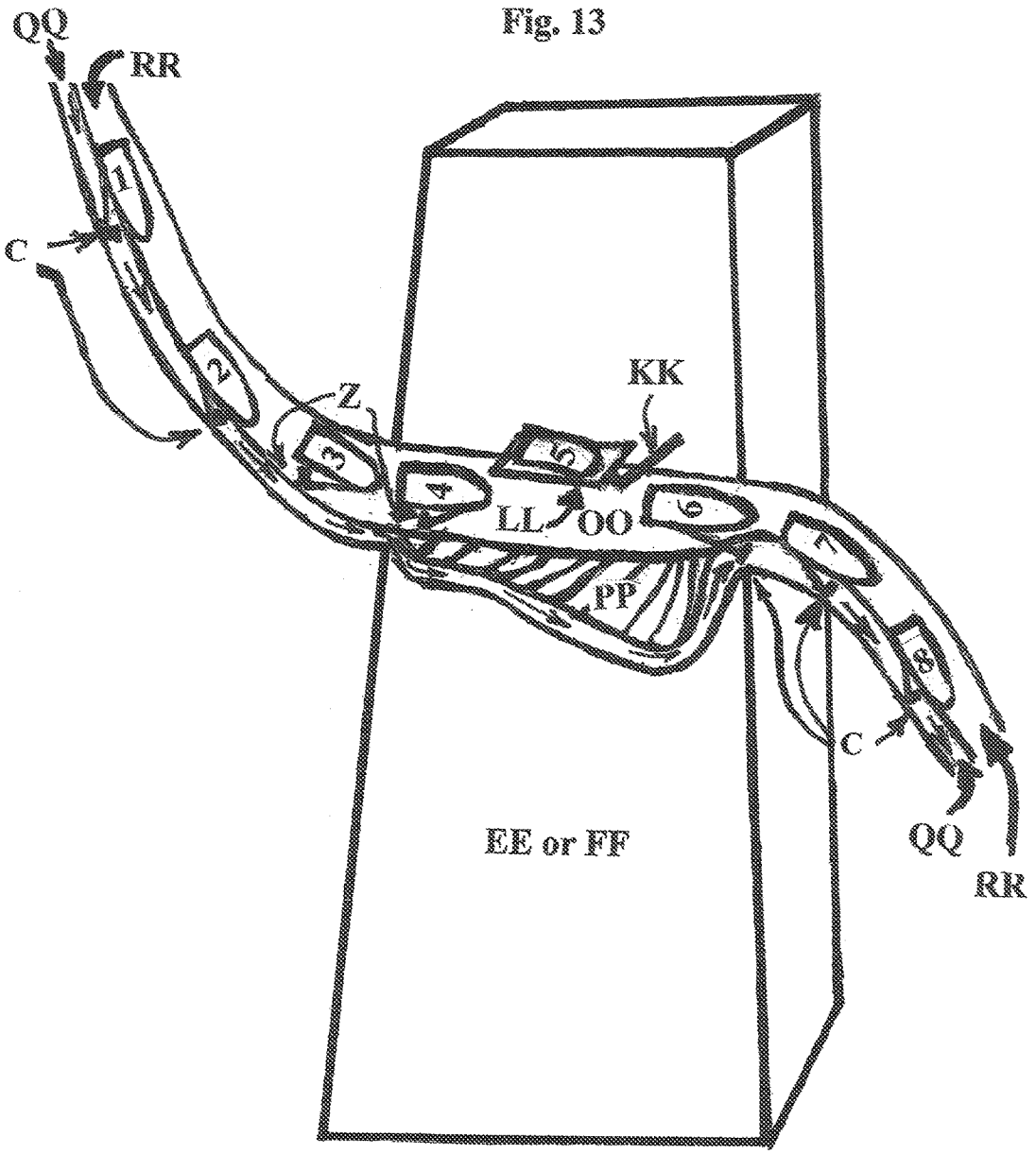

The skiffs will ride on jets of water created by bumps in the bottom and sides of the water troughs that push the bottom of the skiff away from the sides of the trough and push up from the bottom of the trough so that there will be only friction with water between the trough and the skiff (see FIGS. 4 and 10). The fast lane of water will travel down an oblong-shaped water-trough with an opening at the top of the water trough (see FIG. 4) so that a baffle on a centerboard (B in FIG. 4) can be lowered from the skiff to catch the fast current, and later raised to release the skiff from the fast-moving current of water.

The oblong-shaped water trough underneath the water of the wider water trough will act like a Jacuzzi jet of water in a hot tub. The water in the oblong-shaped water trough will move very quickly, but the water above that trough will be slower moving—as is the case with the still water at the top of a hot tub that is undisturbed by the Jacuzzi jets below the surface.

Figure 2:
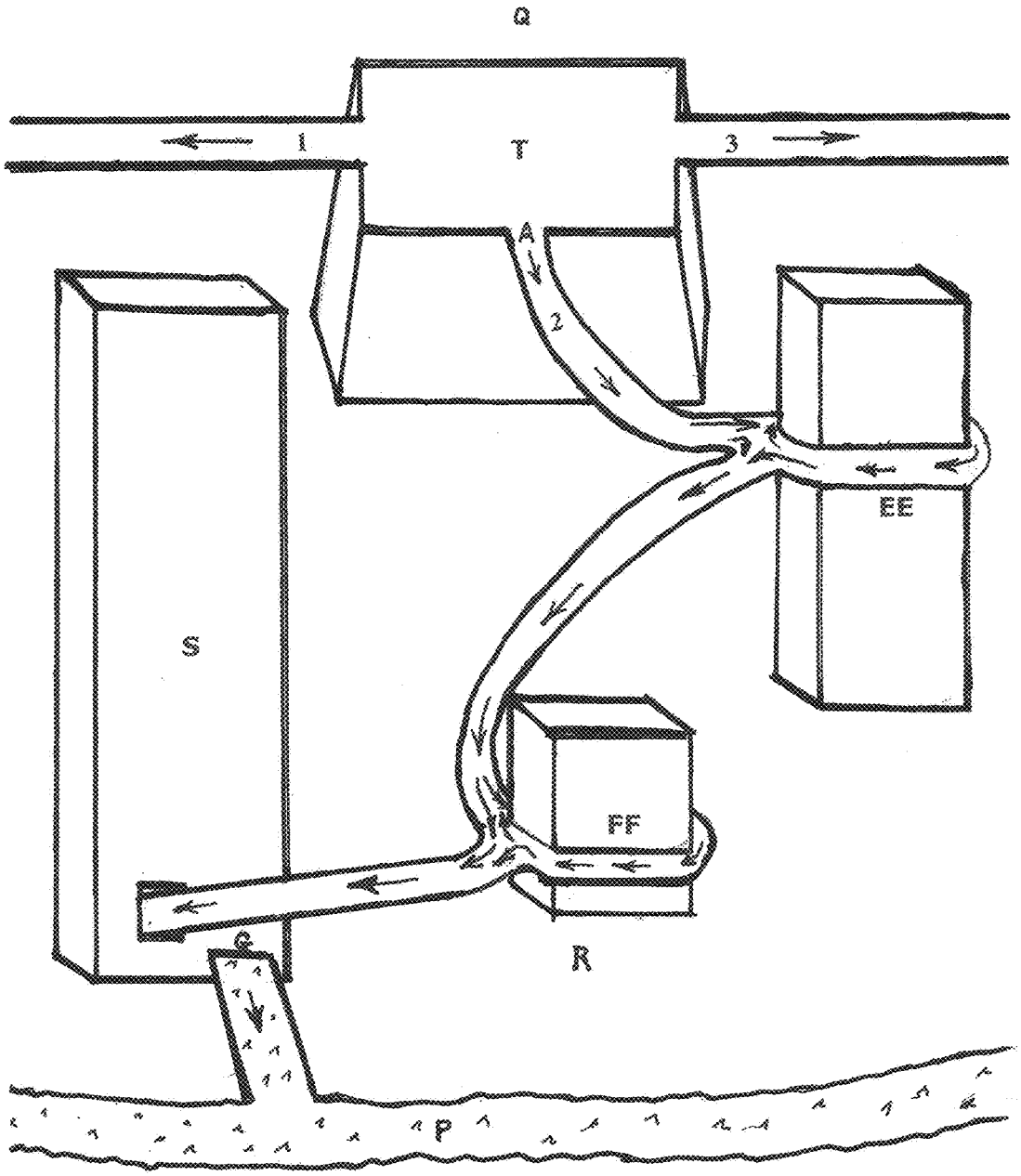
Figure 7:
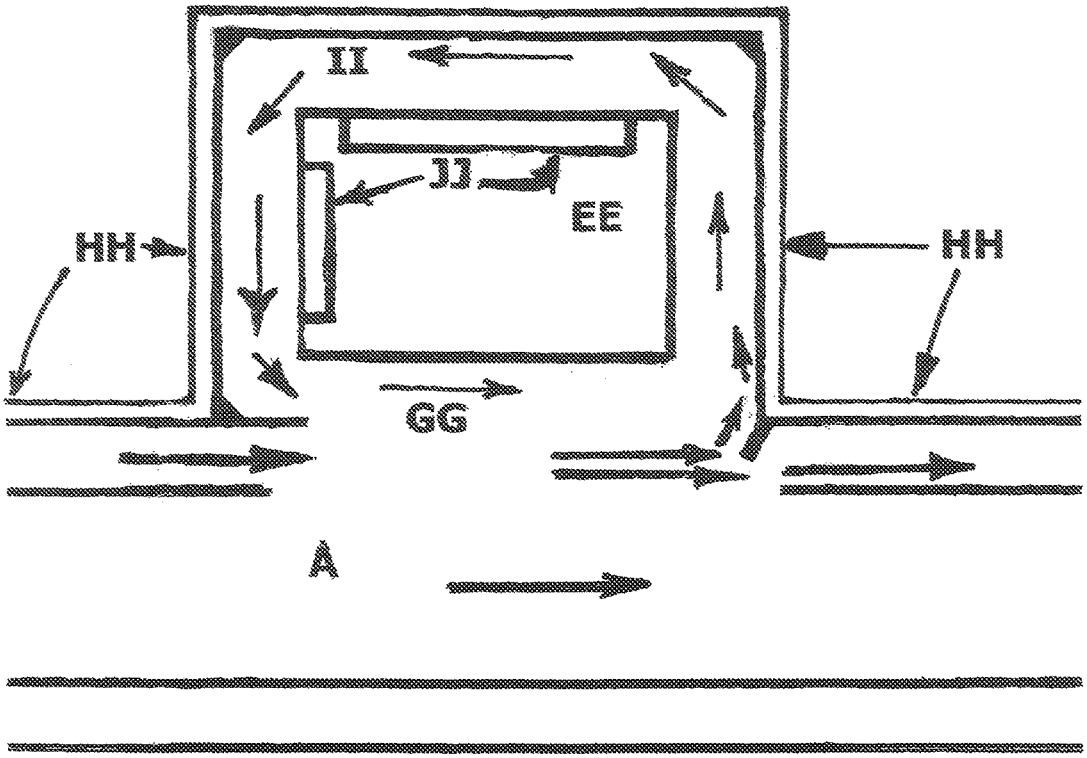

When the commuter in the skiff (or the skiff's computer) wants to slow to a stop, the commuter can raise the center-board and remove the baffle from the fast lane of water, and then turn the rudder so that the skiff changes into the slower lane of water, and eventually, steer into an eddy of still water and dock (see FIGS. 2 and 7).

FIG. 2 has no text; so Inventor Stauffer provides the following key to the labels:

A Start of water trough on 30$^{th}$ floor of the Vancouver parking T.
G Exit for trough water to flow to Willamette River P.
P Willamette River.
Q Vancouver, Wash., suburb of Portland, Oreg.
R Portland, Oreg., city by suburb of Vancouver, Wash.
S Thirty story parking structure in Portland, Oreg.
T Thirty story parking structure in Vancouver, Wash.
EE Forty story building in Portland Oreg., with dock.
FF Ten story building in Portland, Oreg., with dock.

Figure 3:
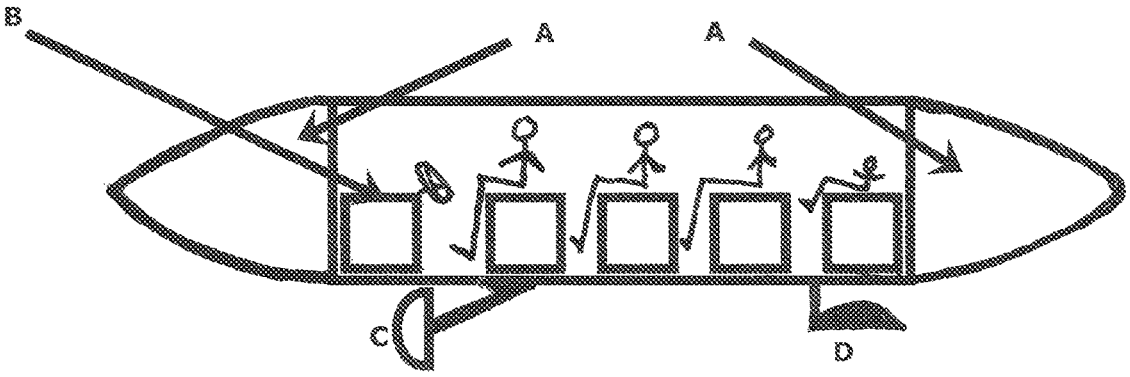

The key to the letters in FIG. 3 is as follows:

A Air pockets for flotation.
B Steering wheel and/or GPS for computer steering.
C Baffle in lowered position to catch fast water current,
D Rudder for steering out of fast water current.

The key to the letters in FIG. 4 is as follows;

A View from back of skiff with Baffle B lowered into fast-moving water trough C.
B Baffle lowered into fast-moving water trough C.
C Pipe for fast-moving jet of water (like a Jacuzzi Jet).
D Deflectors to send water current towards the baffle to prevent friction between the Baffle B and the sides of the trough.
E Water trough to retain water all around the fast-water pipe and enough water so that the skiff and skiff commuters will float.

Figure 5:
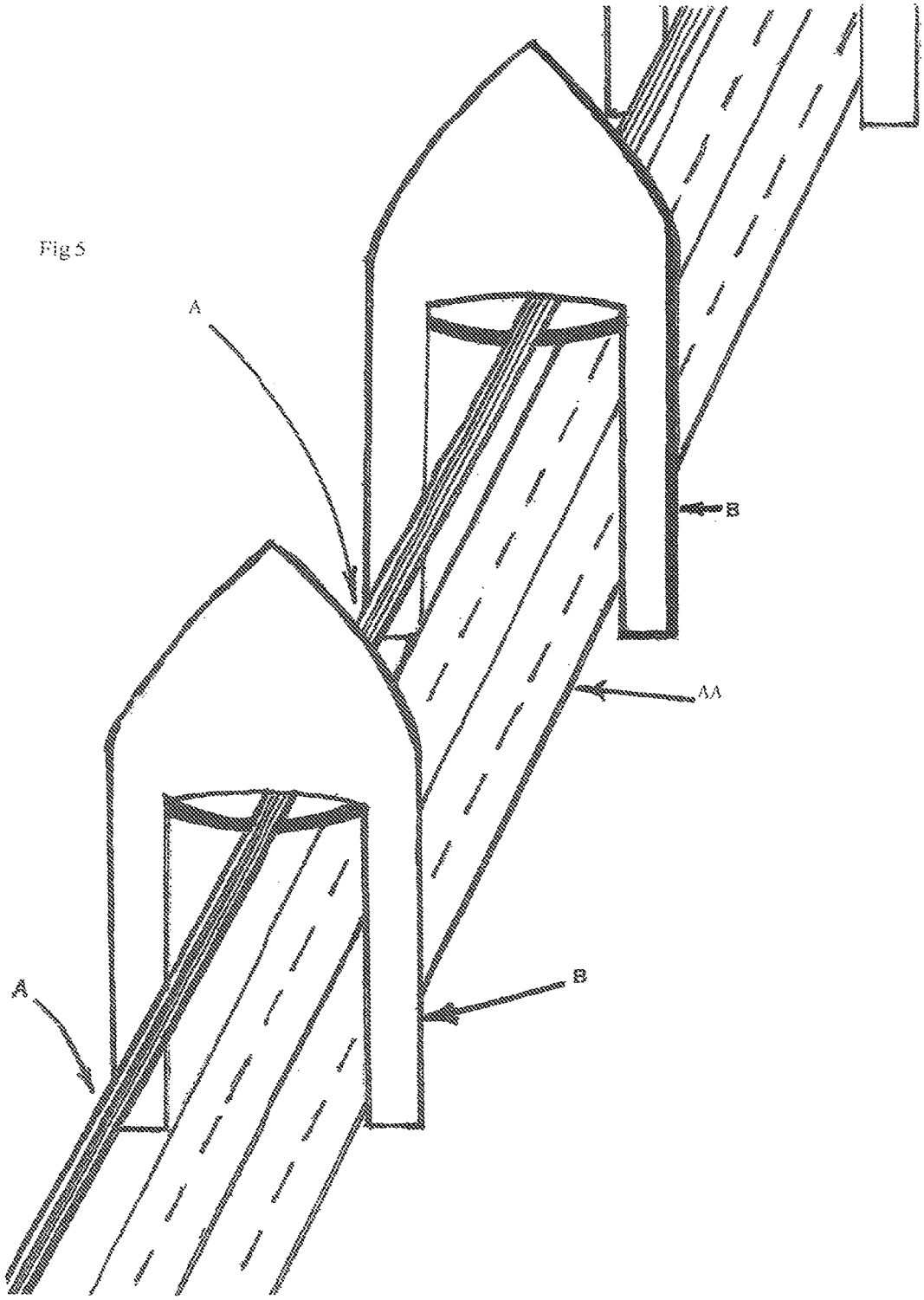

FIG. 5 has no text; so Inventor Stauffer provides the following key to the labels:

A Water trough held above freeways by Arches B.
Arches above the Interstate I-5 freeway AA.
AA Interstate I-5 freeway.

Figure 6:
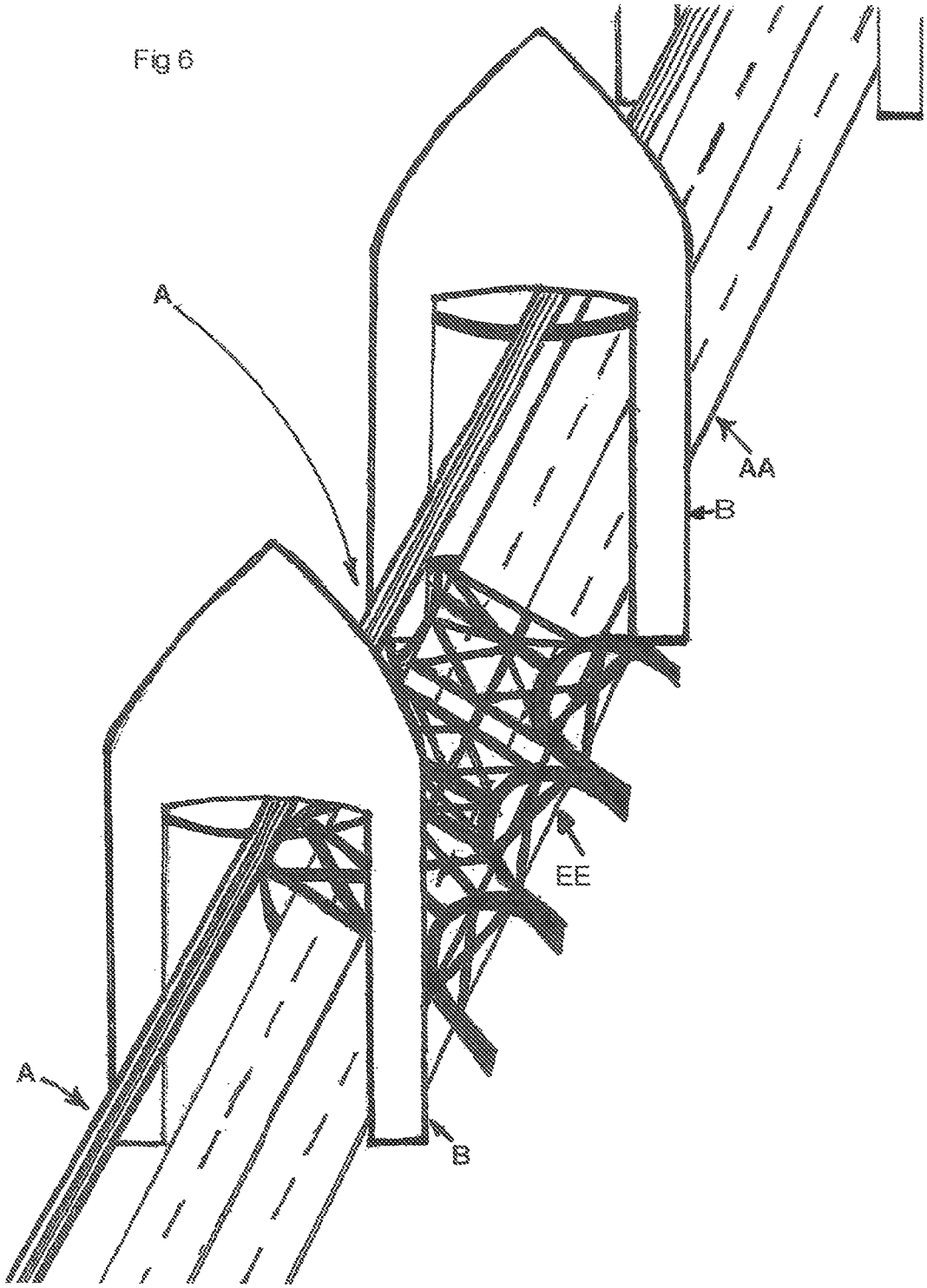

FIG. 6 has no text; so Inventor Stauffer provides the following key to the labels:

A Water trough held above freeways by Arches B.
B Arches above the Interstate I-5 freeway AA.
AA Interstate I-5 freeway.
EE Interstate Bridge over Interstate I-5 freeway.

FIG. 7 has no text; so Inventor Stauffer provides the following key to the labels:

A Fast water trough sunken below slow-moving water GG.
EE Multi-story high-rise building.
GG Slow moving water in water trough above fast water A.
HH Walkway, wheelchair and bicycle path.
II Eddy of water around building EE.
JJ Dock for skiff disembarking and embarking.

Figure 8:
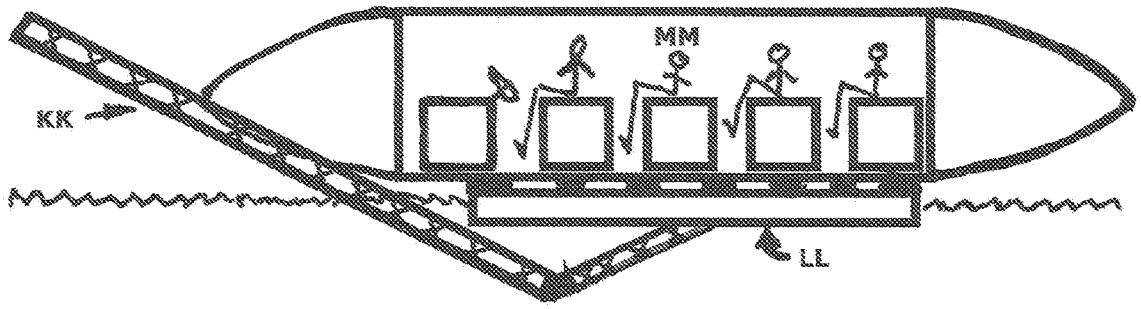

FIG. 8 has no text; so Inventor Stauffer provides the following key to the labels:

MM Skiff lifted out of water by lever KK lifting table LL.
LL Table that is leveraged by lever KK to lift skiff MM.
KK Lever that lifts table LL so that skiff MM is out of the water and stable enough for commuters to safely embark and disembark between the dock and skiff MM.

Figure 9:
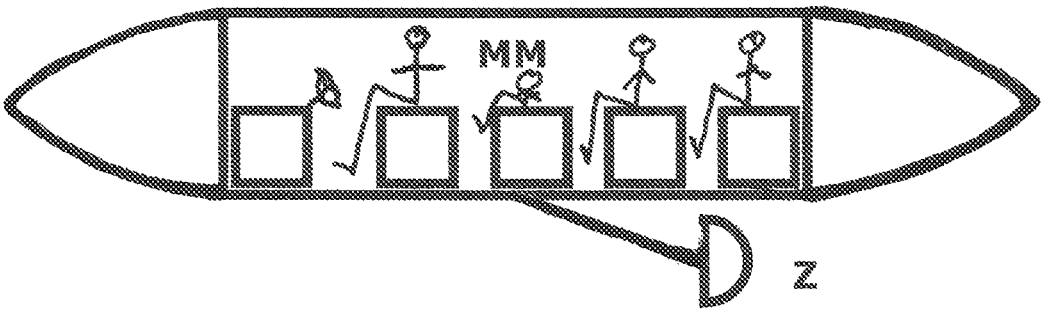

FIG. 9 has no text; so inventor Stauffer provides the following key to the labels:

MM Skiff with centerboard baffle Z dropped in water for braking.
Z Baffle for skiff MM to brake the speed of skiff MM.

FIG. 10 has no text; so Inventor Stauffer provides the following key:

The figure represents the vectors of the flows of water within a section of the water trough A. On the inside of the trough, there are baffles that direct the flow of water towards the center of the trough before that water flows further down the trough. This center direction will push the skiffs, with their lowered baffles towards the enter of the trough so that there will be no friction between the skiffs, with their lowered baffles and the sides or bottoms of the water trough structure, so that skiffs and baffles will not be worn down by colliding with the sides or bottom of the water trough.

There will be a slower-moving lane of water do the side of each fast moving water trough, and then walkway on the other side of each slower moving water trough (see FIG. 7)

so that, if the water should ever be stopped, commuters can exit their skiffs and walk down the walkway to a stairwell or elevator in the arch supports of the trough, and exit the structure. After docking, the skiffs will lodge on a table that has a lever mechanism (see A in FIG. 8) which is capable of lifting the skiff out of the water and rendering it motionless in order for the commuter to easily and safely disembark from the skiff.

Empty skiffs which have arrived at the lower levels of the parking structure will be placed on a conveyor belt or elevator so that they will be delivered to the top of the building (see DD in FIG. 1). At the top of the building, a pipeline of fast-flowing water will be provided and deliver fast-moving water into a water slide trough that will drop off the $30^{th}$ floor (see A in FIGS. 1 and 2), greatly speed up the water to the speed of the water that flows off the top ledge of Niagara Falls—perhaps to a speed that is just short of terminal velocity, which, for a sky-diver is about 122 Miles Per Hour—and travel over the I-5 bridge (see FIG. 6) across the Columbia River, over the I-84 and I-5 freeways (see FIG. 5) and into downtown Portland, where the skiffs, or small boats, will steer off the fast current by raising their centerboards and baffles, steering off the top of the fast-water curry and into an eddy (see FIGS. 2 and 7), and then lowering their centerboards and deploying the centerboard baffle to t use friction with the water to slow the speed of the skiff (see FIG. 9), and then steer into slower-moving lanes of water created by an eddy that forms behind an obstruction (see FIGS. 2 and 7) on the dock side of the fast-moving water stream so that eventually, they will come to a stop at docks (see FIG. 7) and be lifted out of the water (see FIG. 8) so that the riders can disembark from a solid, steady, unmoving skiff onto a solid, steady, unmoving dock surface on the third floors of many downtown Portland (or St. Johns or Gresham—1 and 3 in FIG. 2) buildings.

The fast-flowing water will also be slowed by the creation of an eddy around each third-story, or so, of each building where skiff docks are provided (see FIG. 2). An eddy is a fluid dynamics phenomenon that is described by Wikipedia as follows:

> "In fluid dynamics, an eddy is the swirling of a fluid and the reverse current created when the fluid flows past an obstacle. The moving fluid creates a space devoid of downstream-flowing fluid on the downstream side of the object. Fluid behind the obstacle flows into the void creating a swirl of fluid on each edge of the obstacle, followed by a short reverse flow of fluid behind the obstacle flowing upstream toward the back of the obstacle. This phenomenon is most visible behind large emergent rocks in swift-flowing rivers."

FIG. 2 EE, FF and S in FIG. 2—and the water trough running by the buildings illustrates how, in this mass-transport system, each building will become an "emergent rock in the swift-flowing stream" and the eddy of water that is created behind the building gate (FIGS. 2 and 7) will slow the skiffs so that they can dock in the building's docks. On the upstream side of a building, the fast-moving trough of water will become broader so that the skiffs can raise their baffles out of the fast-moving trough and deploy centerboards to slow the skiff (see FIG. 9) and steer over to the slower moving water created by an eddy around the building. A little past the building, the broader water trough will encounter a solid gate (see FIGS. 2 and 7) that will steer the flow of water away from the direction of the fast-flowing water stream, and direct it to swirl all the way around the building at an upper floor of the building, in the eddy created by the gate. This eddy will slow the water, and the skiffs riding in the water, to a point where the skiffs can easily stop and dock at provided docks (see FIG. 7) and be levered up out of the water (see FIG. 8) to become motionless and to allow their passengers to safely disembark from a nonmoving surface.

Once commuters have disembarked from their skiff at a first building (see EE in FIG. 2), their empty skiff will continue in the slow-moving water lane to the 30-story parking structure (see S in FIGS. 1 and 2). If there are commuters who wish to travel from building EE (FIG. 2) to building FF (FIG. 2), they will embark on a recently-vacated skiff and travel to their desired building location. Engineers will customize the number of downtown buildings with as many docking buildings as are needed.

After riders have disembarked from their skiffs, their skiff will continue going downstream to the lower floors of another parking garage in downtown Portland, where the skiffs will enter, and be placed upon, a conveyor belt/elevator that will take the empty skiffs to the $30^{th}$ floor so that commuters that wish to return to Vancouver can embark on them to ride another trough of water that goes over the freeways and bridges back to the low floors of the parking structure where they originally parked in Vancouver (see T in FIG. 1), so that they can then take an elevator to their parked cars and leave the parking structure to go back to the homes from which they had departed in the morning.

After the arriving skiffs are removed from the stream of water, the water trough will continue down to the Willamette River, or into a pipe to the Willamette River, where the water trough will empty into the river (G in FIG. 1).

FIG. 2 shows a more complex path for the water troughs. Instead of just one trough, there will be three or more troughs (see 1,2 and 3 in FIG. 2) that will eventually go to various different locations in the city (see 1 to St. Johns, 2 to Portland, and 3 to Gresham in FIG. 2). The water troughs will loop around several buildings with docks. As depicted in FIG. 2, each loop around a building will have the fast water trough plus an eddy of more shallow water in the trough for the skiff to slow down and dock. Commuters will have a choice to steer off the fast trough and go to slower water for docking. The fast trough will then continue to other buildings before the water flows down to ground or river level (see G in FIGS. 1 and 2).

FIG. 2 depicts the water trough going from the dock at one building (EE in FIG. 2) to the dock at another building (FF in FIG. 2) by steering into a building's eddy (see FIG. 2).

FIG. 8 shows the lever action by which a table underneath a stopped skiff will be lifted out of the water and made motionless so that commuters can exit, and other commuters can embark on the skiff.

FIG. 9 shows the procedure by which the skiff raises its centerboard and baffle and leaves the fast trough of water, and then steers into the slower water and drops the centerboard and baffle so that the friction against the slow water brakes and slows the skiff.

FIG. 10 shows the water jets made by bumps on the sides and bottom of the troughs that eliminate friction between the sides of the skiff and the walls of the trough in the fast part of the trough.

Each top floor will have ten embarking points for commuters to get into one fast-water trough so that many commuters can fill any one of the troughs with commuters. With this feature, the quickly-travelling skiffs in any trough will be no more than a meter apart and there will not be wasted space in the trough between skiffs, which will be an improvement over freeways where cars have to leave space between their car and the car in front of them so that, if the car in front of them slows or stops, they have the time and space to safely stop; this mass transit transportation system assumes that all skiffs will be travelling the same speed in the trough of fast-moving water, and that the skiff in front will never stop or slow until that skiff raises its baffle out of the fast-moving water stream and steers to the side into a slow-moving lane or an eddy.

It should be noted that this mass transportation system transports commuters back and forth from Vancouver to Portland without using any gasoline, and without releasing carbon emissions into the air. The pollution-free forces of gravity and flowing water are almost the only energy sources for this mass transportation system. If more speed is desired at any one section of water trough, auxiliary pumps can be provided to make the water flow faster, but, in general the force of gravity will be sufficient to create the desired speed of the water in the water trough.

The thirty-story parking structures will have, in one embodiment, a round shape and the cars will drive on a one-way, two-lane, circular road (with many adjacent parking spaces) up a gradually-increasing spiral to the $29^{th}$ floor. Parking spaces will be on the inside of the two-lane road. The lane that is farthest inside can be used to slow down to approach a parking spot on the inner edge of the building, as well as to allow for cars to back out of parking spots, while the lane that is farthest outside can be used for faster traffic to continue up the parking structure to find an open parking space. The parking structures will have a footprint on the ground that is sufficient in size to support the expected number of parking spaces. If the number of parking spaces is insufficient, a second parking structure will be built until the number of parking spaces is sufficient for the demand.

There will be the preferred embodiment, another one-way, two-lane, circular road that goes down from the $29^{th}$ floor to the street-level floor, with parking spaces on the inside and a road lane in which, to slow down to enter the parking spaces and to back parked cars from the parking spaces so that they can get into the fast lane and drive down the lane to the exit, of the building.

Each of the two spiral one-way, two-lane roads will have parking spaces on the inside of the inner lane, where cars can park, and their occupants can walk to the elevators at the center of the building.

In addition, the area around the elevators, in the center of the parking structure, will be filled with bathrooms and shops such as grocery stores, restaurants, sporting good shops, banks, hospitals, emergency room, hardware stores, bars and taverns, etc., so that all the vendors in downtown Vancouver can make sales to the many commuters that will be parking in the parking garage. The businesses in downtown Vancouver will have the first opportunity to move their businesses to the parking structure. Also, they will experience increased business in their downtown location because there will be less traffic for their customers to travel downtown, and more parking for their customers when they get to the downtown businesses. Essentially, the thirty-story parking structure will become a vertical shopping and recreation center.

The sudden drop of the skiffs they ride the trough of mater, from the $30^{th}$ floor of the parking structure, will also be an amusement park ride for these that want to experience thrills; however, more gradual slopes of water might be provided for those that are fearful of the sudden drop.

The envisioned water trough will be unlike present freeways because there will be no stopped or slow in the fast lanes—and no need to apply brakes—and no slowing for lane changes. There will be no oncoming traffic, and no head-on collisions because all the skiffs and all the water in any trough will be going only one way. There will be no stoplights or stop signs. The skiffs will be above bridges like the Interstate Bridge so that they will not have to stop when the bridge lifts to let ships and boats have the right of way. The speed of the traveling skiffs could approach terminal velocity of 122 miles per hour. If skiffs are going 122 miles per hour in a clear plastic water trough, over freeways that are at a standstill, the commuters on the freeways will see the fast-moving skiffs and become jealous. They will then want to switch to the skiffs and get to their destination much faster than commuting in their car or truck. At 120 MPH, a ten-mile ride will take five minutes. At 60 MPH, a ten-mile ride will take ten minutes.

All water troughs will have a system of cameras and motion-detectors that will be monitored so that, if one section of a trough is suddenly broken, the water feeding the trough can be immediately turned off so that skiffs in the trough will come to a stop before going off the edge of the broken section of trough. In addition, each trough will have one or two safety nets or structures that will catch any skiffs that fall off the edge of a broken section. All water troughs and arches will also have beacon lights so that airplanes can avoid them.

The water troughs will be suspended from tall arch structures that will rise above bridges and freeways. Each arch structure will be an apartment house complex capable of comfortably housing low-income to high-income residents, and will have an appropriate utilidore to provide heat, electricity, water, sewage, garbage, and TV cables or wifi connections. Each arch will have an elevator and stairways. The arches will be connected by handicap-accessible walkways with separate paths for one-way bicycle traffic.

DETAILED DESCRIPTION OF THE INVENTION

In most cities, no more lanes can be added to existing bottleneck freeways, roads, and bridges over water. However, light-weight water troughs can be built in the free and open space that is about twenty feet above these bottleneck freeways and bridges. Instead of pouring the tons of concrete needed for another freeway lane that can support 50-ton trucks and cars, it will be tar less expensive to utilize the open space above roads, freeways and bridges to construct a much-lighter—probably made with a light plastic material—water slide capable of supporting people in light-weight skiffs or small boats on a light-weight stream of fast-moving water. The existing roads, streets, freeways and bridges can continue to be the pathways for heavy vehicles with heavy motors, frames, tires, and trailers. Much-lighter skiffs can do the transporting of the much smaller weight of commuters and their hand-carried briefcases and bags. The energy-saving and pollution-decreasing advantages of this water trough mass transportation system arise from the replacement of single commuters in heavy cars, burning fossil fuels and releasing toxic exhaust, with a light-weight pollution-free skiff or small boat that carries that single commuter—or several more companion commuters—without burning any fossil fuel or polluting the air with exhaust.

In contrast to other mass transit methods—such as busses or trains—there will be no need for a skiff driver. The driverless skiffs will be restricted to the path of the trough and be continually and instantly ready to leave the parking structure because there will be a constant supply of skiffs or small boats that will be circulating through the fast trough of water from, in one embodiment, Vancouver, Wash., to Portland, Oreg., and back to Vancouver, Wash. There will be no need for a schedule of departure times and arrival times because the skiffs or small boats will be constantly arriving and departing. Hence commuters will not have to check for departure times and schedule their trips in order to catch a certain train or bus at a certain time; the commuters will be able to arrive at any time and quickly embark on a skiff to begin their trip.

To get the stream of water to the top of the thirty-story parking garage, David Stauffer's RIVER BOTTOM SIPHON FOR HYDRO-ELECTRIC GENERATION AND IRRIGATION, patent application Ser. No. 13/734,978, can supply an almost free stream of water to the top floor, without pumping, so that a water trough for a water-slide-type public mass transportation system could waterfall off the top of the parking structure and support small boats or skiffs that will travel down the water slide, over the tops of bridges, freeways and roads to downtown locations miles away. Inventor Stauffer's RIVER BOTTOM SIPHON will start many kilometers upstream where the water is higher than the thirty-story parking garage and flow through a pipe on the bottom of the river to the top of the parking garage. Such a transportation system could transport 5,000 to 10,000 commuters each day so that there will be 4,000 to 8,000 fewer cars caught in the daily bottlenecks of traffic. When there are 4,000 to 8,000 fewer cars caught in the daily bottlenecks of traffic, air pollution from ear and truck exhausts will be greatly reduced and the cars and trucks that continued to use existing roads and freeways will be going faster so that they will not be braking, and then accelerating, in stop and go traffic, or be creeping along, or sitting still in traffic—and burning gas while idling.

When there are 4,000 to 8,000 fewer cars travelling into downtown areas, there will be no need for several thousand parking spaces in the downtown area, and commuters that do not need to park their cars in downtown areas will save the cost of parking fees, as well as the gas that they formerly bought to power their cars and trucks when they were using cars and trucks to commute. They will also save money on maintenance fees for cars and trucks that they will no longer use to commute. Tires will last longer—as well as oil changes, transmission repairs, brake pads, and lube jobs.

Virtually all large cities and towns have rush-hour traffic bottlenecks. Portland, Oreg., has rush-hour traffic bottleneck both the morning and the evening on the I-5 freeway and the I-205 freeway going between Vancouver Wash., and Portland, Oreg.

Virtually all downtown city streets have slow-moving traffic due to the congestion of cars and the need to have stop signs and traffic lights that completely stop the cars caught in the congestion. Virtually all downtown cities, however, have downtown buildings that are three stories high, or taller, and there is an abundance of open space three stories above the city street surfaces that could be used for a system of light-weight water troughs with docks on about the third stories of those high downtown buildings.

The invention claimed is:

1. A mass transportation system of moving people via water slides or water troughs between two or more parking structures, comprising a first structure and any number of additional parking structures, including one structure that is a high-rising parking structure of as many as thirty stories, in a suburban area and at least one other parking structure that is a high-rising parking structure of as many as thirty stories in a downtown area, a plurality of water slides or water troughs connecting the first structure and the other structure; each parking structure having a primary level dock for arriving skiffs, and a secondary level dock for departing skiffs, wherein the primary level dock is lower than a secondary level dock, and a conveyor belt that will take unoccupied skiffs from the primary level dock to the secondary level dock to enter the higher level water troughs that commuters will use to depart off the secondary level dock and travel down to lower levels in other buildings and parking structures, and elevators that stop on each floor and go all the way to the top floor, and various shops, restaurants, bathrooms around all the elevator entrances on each floor, and said dock for arriving skiffs being on a primary level where skiffs or small boats that float in from the top of another parking structure will be placed on said conveyor belt and transported to the secondary level dock of the parking structure so that commuters can go to the secondary level dock and embark on skiffs or small boats to ride down a water slide or trough that falls off the secondary level dock of the parking structure all the way to a primary level dock of another parking structure, and a drain pipe to transport trough water, that has been emptied of commuters and skiffs down to a river for disposal.

2. A mass transportation system of moving people between two or more parking structures, comprising skiffs or small boats capable of holding human commuters that wish to go from one parking structure as claimed in claim 1, to another parking structure and which are structured so as to be capable of slowing to a stop at docks, and have:

a. a steering system, either manually-controlled or controlled by a computer,
b. seat belts for all passengers,
c. sealed air pockets for flotation if the skiff should ever be submerged in water,
d. air bags for each passenger,
e. a cell phone for emergency communications,
f. rounded front and beck structures to decrease the impacts of head-on crashes and rear-end crashes,
g. braking baffles on the bottom to slow the skiffs by friction with the water below the skiffs.

3. A mass transportation system of moving people between two or more parking structures, comprising water troughs, with baffles to prevent friction between skiffs and the sides and bottom of the water troughs, that go between the parking structures, as claimed in claim 1, as well as going to other buildings, which will be structured so as to safely and securely transport commuters at speeds up to 122 miles per hour from the secondary level dock of one parking structure, around buildings to the primary dock levels of other parking structures, and which will be constructed at least twenty feet above present streets, roads, freeways and bridges, and have:

a. side-wall gates that will form water eddies around route buildings to create slow-moving water that will allow the skiff or small boats to slow to a stop and
b. a curved valley structure of the water slide or water trough which is shaped so that skiffs will leave the secondary level dock and accelerate, by the force of gravity, until the skiffs reach the bottom of the water trough or water slide valley, and then decelerate, by the force of gravity, as the skiffs arise up the other side of the water trough (or slide) valley to a slower-moving eddy structure to slow enough to dock on another building,
e. pools of slow-moving water on which skiffs will float far enough above the stream of fast-flowing water that the fast-flowing stream will not push them and they will drop a slowing baffle to slow down so that they can be lifted on a table by a lever so that the skiffs will be motionless for commuters to embark and disembark and, when commuters have embarked, the skiff will be lowered to the pool level, and then the pulling baffle will drop into the fast-moving water of the trough, and the skiffs will accelerate up to the speed of the fast-moving water of the trough and, once slowed by an eddy or the deceleration of an upward trough or a slow-water pool, the skiffs will be lifted out of the water by lever-action lifers, or other mechanical lifters, underneath flat tables underneath the stopped skiffs so that the skiffs will become stable enough for commuters to step from the docks to the skiffs, or from the skiffs to the docks, with little motion by the skiffs or small boats.

4. A mss transportation system of moving people between two parking structures of claim 3, wherein the water troughs will have two safety nets below them to catch any skiff that falls from a water trough, and will be suspended from tall arch structures that will rise above bridges and freeways, and each arch will be a housing complex that will house low-income to high-income residents, and will have a utilidore that will have structures to create and provide:

a. heat,
b. electricity,
C. water,
d. sewage removal,
e. TV cables,
f. wifi connections,
g. an elevator,
h. stairways,
i. handicap-accessible walkways, and
j. separate structures for two one-way bicycle traffic lanes.

* * * * *